US005479729A

United States Patent [19]

Eslambolchi

[11] Patent Number: 5,479,729

[45] Date of Patent: Jan. 2, 1996

[54] METHOD AND APPARATUS FOR CONTROLLING EXCAVATION EQIUPMENT

[75] Inventor: Hossein Eslambolchi, Bedminster, N.J.

[73] Assignee: AT&T Corp., Murray Hill, N.J.

[21] Appl. No.: 223,248

[22] Filed: Apr. 4, 1994

[51] Int. Cl.[6] ..... F02F 1/00

[52] U.S. Cl. ..... 37/195; 37/348; 414/694; 414/699

[58] Field of Search ..... 37/348; 329/326; 414/694, 698, 699, 157, 160; 405/157, 160

[56] References Cited

U.S. PATENT DOCUMENTS

| | | | |
|---|---|---|---|
| 3,858,737 | 7/1975 | Senoo | 414/699 |
| 3,871,536 | 8/1975 | Brown | 37/348 X |
| 3,907,136 | 9/1975 | Christides et al. | 414/694 |
| 3,911,602 | 10/1975 | Trevathan | 37/348 X |
| 4,387,340 | 6/1983 | Peterman | 324/326 |
| 4,542,344 | 9/1985 | Darilek et al. | 324/326 |
| 4,600,356 | 7/1986 | Bridges et al. | 37/348 X |
| 4,621,375 | 11/1986 | Simnovec | 455/603 |
| 5,045,368 | 9/1991 | Cosman et al. | 405/157 X |
| 5,231,355 | 7/1993 | Rider et al. | 324/326 |
| 5,371,959 | 12/1994 | Ahs | 324/326 X |

OTHER PUBLICATIONS

"A Consortium for Safe Excavation (CSE)," Advertisement made by the Construction Automation and Robotics Laboratory of North Carolina State University.

*Primary Examiner*—Ramon S. Britts
*Assistant Examiner*—Frederick L. Lagman
*Attorney, Agent, or Firm*—Robert B. Levy

[57] ABSTRACT

Control of a piece of excavation equipment (10) to temporarily disable it from further excavating in an area where a buried cable and/or pipe (50) is present is accomplished by providing a detector (54) for sensing if the buried cable and/or pipe is sufficiently close to be potentially damaged. The detector provides a signal indicative of the presence of the buried cable for transmission, via a transmitter-receiver pair (56, 60), to a control valve (62). When a buried cable and/or pipe is detected, the control valve is actuated to divert hydraulic oil that would otherwise flow to a cylinder (44) that provides forward movement of a bucket (38) on the excavating equipment, thereby preventing further excavation by the bucket in the region of the buried cable and/or pipe.

6 Claims, 2 Drawing Sheets

METHOD AND APPARATUS FOR CONTROLLING EXCAVATION EQIUPMENT

TECHNICAL FIELD

This invention relates to a technique for controlling a piece of excavation equipment, such as a backhoe, to disable the equipment from digging near a buried cable and/or pipe.

BACKGROUND OF THE INVENTION

Many of the cables maintained by electric and telephone utilities and telecommunication carriers, and many of the pipes maintained by water and gas utilities and pipeline carriers are buried underground for esthetic reasons as well as to protect such cables and pipes from damage. However, underground burial is no guarantee against damage. Indeed, it is not uncommon for a buffed cable or pipe to be severed, usually with disastrous results. For example, when a buried cable carrying telecommunications traffic is severed, a major service disruption usually occurs. When a buffed pipe carrying natural gas is severed, an explosion and/or fire often results, causing property damage and injury or even loss of life.

The most common way a buried cable or pipe is severed is by excavating in an area near the cable or pipe. Often, a contractor, using a piece of excavation equipment such as a backhoe or the like, will begin excavating at a site unaware that one or more buffed cables and/or pipes lie beneath the ground being dug. Given the power of present-day excavation equipment, an operator of such equipment can easily sever a cable or pipe very quickly. After a buried cable or pipe is severed, the utility, telecommunications or pipeline carrier that maintained the cable or pipe usually will pursue a legal claim against those responsible for the damage. Consequently, contractors who perform excavations now face ever increasing insurance premiums to insure themselves against possible damage claims as a consequence of severing a buried cable and/or pipe.

Because of the enormous adverse impact suffered when a buffed cable and/or pipe is severed, utilities, telecommunications carriers, and pipeline carriers who maintain buried cables and/or pipes have implemented stringent measures to prevent this type of harm. For example, AT&T requires that one or more service technicians be dispatched to the site of an excavation where any AT&T buried cables may be present to locate such cables in advance of any digging, provided that the contractor undertaking such excavation has given advance notice. Once a buffed cable has been located, at least one technician must remain with the excavating contractor during excavation to protect the buried cable against damage. Other utilities and pipeline carriers that maintain buried cables and/or pipes have implemented similar protective measures. Dispatching a service technician to an excavation site to locate a buried cable or pipe as well as to monitor the excavation is an expensive proposition.

Thus, there is a need for a technique that reduces the incidence of severing a buried cable and/or pipe by a piece of excavating equipment as that equipment is operated to excavate a site proximate the buried cable and/or pipe.

SUMMARY OF THE INVENTION

Briefly, in accordance with the invention, a method is disclosed for controlling a piece of excavating equipment, such as a backhoe or the like, to prevent the equipment from severing a buried cable and/or pipe as the equipment is excavating a site near the buried cable or pipe. The method of the invention is commenced by continuously sensing if at least one buried cable and/or pipe is near the excavating equipment. Such sensing can be accomplished in several ways. For example, a buried cable and/or pipe can be made to radiate a signal at a particular frequency to enable the presence of the cable and/or pipe to be established by detecting the strength of the radiated signal. If at least one buried cable and/or pipe has been found sufficiently close to the excavation equipment so as to be potentially damaged if the equipment were to continue to excavate the site, then the equipment is alerted to the presence of the buried pipe and/or cable. Once the equipment has been alerted to the presence of at least one buried cable and/or pipe, then the equipment is temporarily disabled from further excavating the site, but not from withdrawing from the site.

DETAILED DESCRIPTION

Figure 1:
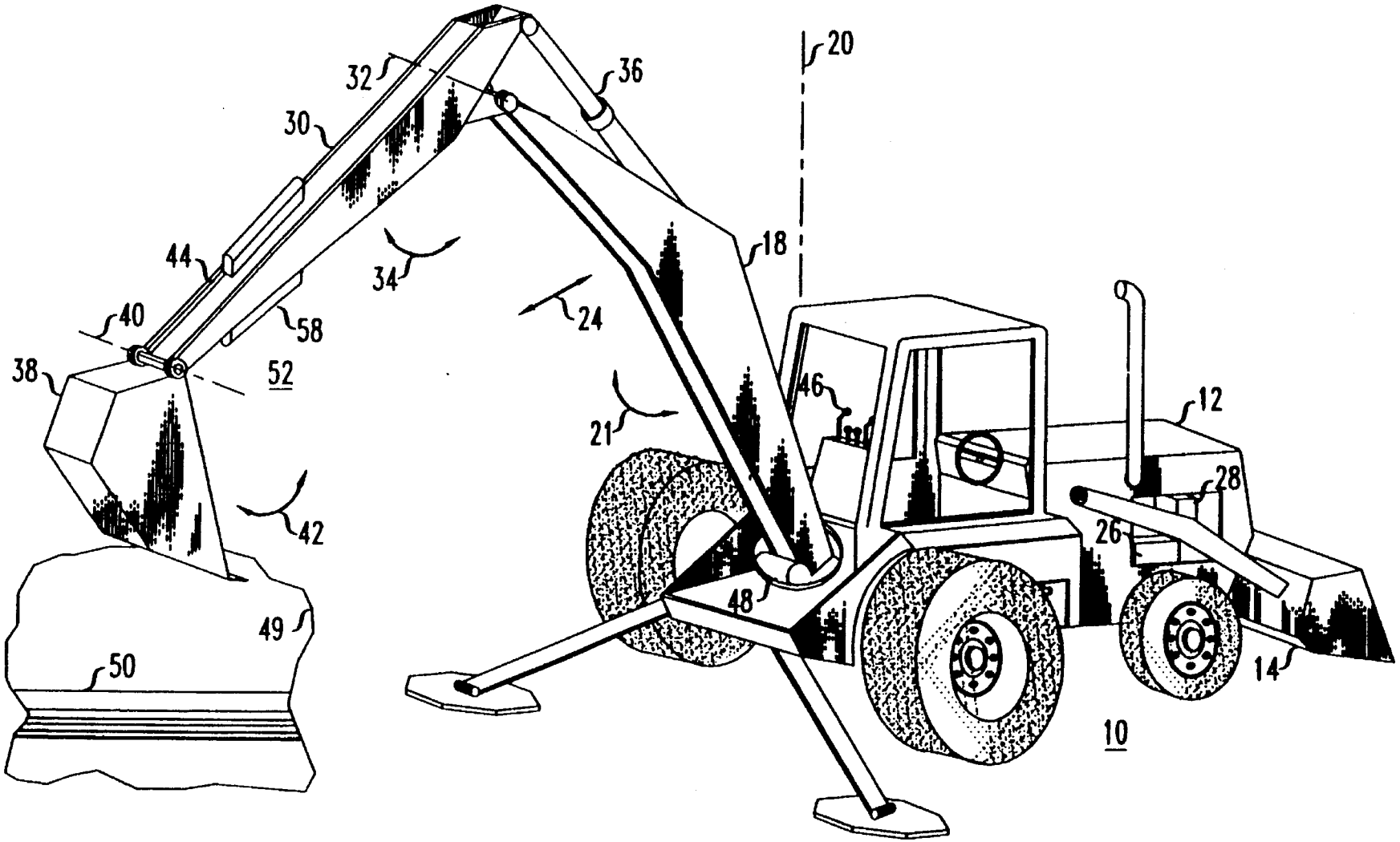
FIG. 1 is a perspective view of a piece of excavating equipment modified in accordance with the invention.

Referring to FIG. 1, there is shown a piece of excavating equipment 10, which in the illustrated embodiment takes in the form of a backhoe of the type commercially available from several different manufacturers. The backhoe 10 is generally comprised of a tractor 12 that has a hydraulically-actuated loader mechanism 14 pivotally mounted to its front (i.e., its right-hand end as seen in FIG. 1). The tractor 12 also carries a backhoe mechanism 16 at its rear (the left-hand end as seen in FIG. 1). The backhoe mechanism 16 comprises a boom 18 that has its lower end mounted to the rear of the tractor 12 for rotational movement about a vertical (z) axis 20 through a limited arc 21. Further, the boom 18 is mounted for pivotal movement about a horizontal axis 22 through a limited arc 24. Hydraulic cylinder means (not shown) are provided for rotating the boom 18 though its arc 21 and for pivoting the boom through its arc 24. The hydraulic cylinder means that pivot and rotate the boom 18 are pressurized by hydraulic oil pumped by a pump 26 driven by an internal combustion engine 28 that also propels the tractor 12.

The boom 18 is pivotally mounted near its upper end to the upper end of an arm 30 to enable the arm to pivot about a horizontal axis 32 through a limited arc 34, the axis 32 being parallel to the axis 22. The arm 30 is pivoted through its arc 34 by way of a hydraulic cylinder 36 mounted between the arm and the boom 18. The hydraulic cylinder 36 is also pressurized by hydraulic oil pumped by the pump 26.

A bucket 38 is pivotally mounted to the arm 30 near the lower arm end so that the bucket can pivot about a horizontal axis 40 through a limited arc 42, the axis 40 being parallel to the axes 22 and 32. A hydraulic cylinder 44 is mounted between the bucket 38 and the arm 30 to pivot the bucket though its arc 42. As with the hydraulic cylinder 36, the cylinder 44 is pressurized by hydraulic oil pumped by the pump 26. The hydraulic cylinders 36 and 44, as well .as the hydraulic cylinder means that pivot and rotate the boom 18, are each controlled by a separate one of a set of operator-actuated valves 46 located at a control station 48 situated at the rear of the tractor 12. By actuating a particular one of the valves 46, an operator can pivot and rotate the boom 18 as well as pivot the arm 30 and the bucket 38.

At the outset of digging, the boom 18 is pivoted counterclockwise about the axis 22, and the arm 30 and the bucket 38 are each pivoted backward (clockwise about their axes 32 and 40, respectively) to position the bucket to engage the ground. Thereafter, the bucket 38 and the arm 32 are each pivoted forward (counterclockwise about their axes 32 and 40, respectively) to cause the bucket 38 to scoop up a quantity of earth and thereby excavate an opening 49 in the ground.

Once the bucket 38 has scooped up a quantity of earth, then the arm 30 is pivoted backward to raise the bucket from the opening 49. (The boom 18 may be pivoted clockwise at this time to further withdraw the bucket 38.) Next, the boom 18 is rotated about its vertical axis 18 and the bucket 38 is pivoted backward (and, possibly, the arm 30 may also be pivoted backward) to enable the earth scooped by the bucket to be dumped in a pile distant from the opening 49. The process of pivoting the boom 18, the arm 30 and the bucket 38 in the manner described is repeated as often as necessary to excavate the opening 49 to the requisite size and depth.

In the process of excavating the opening 49, a buried cable 50 may be uncovered. (Depending on the location of the opening 49, several buried cables and/or pipes may be uncovered. However, for ease of explanation, it will be assumed that only a single buried cable 50 is present in the opening 49.) If the bucket 38 is pivoted forward in the vicinity of the buried cable 50, then the bucket may sever the cable, usually with disastrous results.

Figure 2:
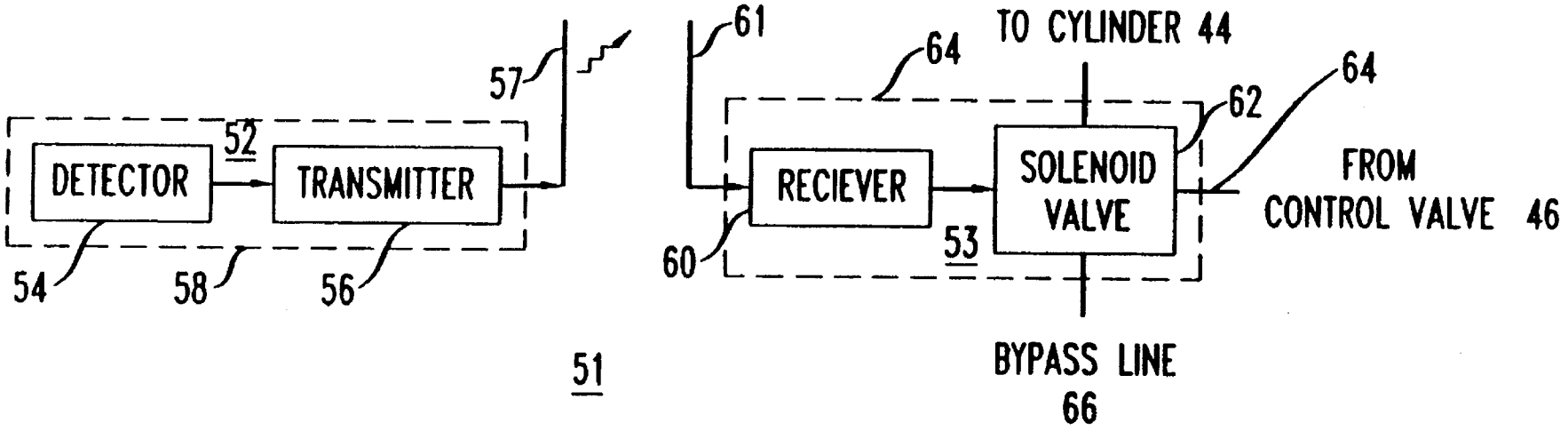
FIG. 2 is a block schematic diagram of a control unit, in accordance with the invention, for controlling the piece of excavating equipment of FIG. 1.

Referring now to FIG. 2, there is shown a system 51, in accordance with the present invention, for temporarily inhibiting the backhoe 10 of FIG. 1 from further excavating the opening 49 (FIG. 1) when the buried cable 50 (FIG. 1) is found to be sufficiently close to the bucket 38 of FIG. 1 so as to be potentially damaged upon further excavation. The system 51 of FIG. 2 includes a detecting apparatus 52 for detecting the presence of the buried cable 50, and a controller 53 responsive to the detecting apparatus 52 for temporarily preventing the bucket 38 of FIG. 1 from pivoting forward so as to further excavate the opening 49 of FIG. 1.

The detecting apparatus 52 of FIG. 2 includes a detector circuit 54 of a type well known in the art for sensing the strength of a signal impressed on the cable 50 for locating purposes. When the detector circuit 54 senses the locating signal impressed on the cable 50 (or impressed on a cable running alongside a buried pipe (not shown)) and determines that the locating signal is above certain threshold signal, then the detector circuit generates an output signal of a prescribed magnitude. The detector circuit 54 output signal is supplied to the transmitter 56. During the interval that the output signal of the detector circuit 54 is at or above the prescribed magnitude, the transmitter 56 generates a Radio Frequency (RF) signal that is radiated via an antenna 57. In practice, the detector circuit 54 and the transmitter 56 are situated, together with a battery (not shown), within an enclosure 58 mounted on the arm 30 of FIG. 1 near the bucket 38 of FIG. 1. The battery is selected to supply both the detector circuit 54 and the transmitter 56 with electrical power to make them independent of the electrical system of the backhoe 10 of FIG. 1

The controller 53 includes a receiver 60 that is coupled to an antenna 61. The receiver 60, which is of a conventional design, is tuned to the same frequency as the transmitter 56 to receive the signal generated by the transmitter when the detector circuit 54 has detected the buried cable 50 of FIG. 1. When the signal from the transmitter 56 is above a prescribed threshold, then the receiver 60 supplies a control signal to a solenoid-actuated valve 62 that is located, together with the receiver, in an enclosure 64 mounted within the control station 48.

During intervals when the transmitter signal is below the threshold (indicating that the buried cable 50 of FIG. 1 is not sufficiently close to the bucket 38 of FIG. 1 to be of concern), the valve 62 remains de-actuated. While de-actuated, the valve 62 passes hydraulic oil carried by a line 64, from the particular control valve 46 of FIG. 1 that controls the forward pivotal movement of the bucket 38, to the cylinder 44 of FIG. 1. Thus, while the valve 62 remains de-actuated, the cylinder 44 nay be actuated, by actuation of its corresponding control valve 46 of FIG. 1, to pivot the bucket 38 forward to further excavate the opening 49 of FIG. 1.

When actuated in response to a signal from the receiver 60 (indicating that the buried cable 50 is sufficiently close to the bucket 38 to be of concern), the valve 62 couples the line 64 to a bypass line 65 coupled to an oil sump (not shown). Under these conditions, the hydraulic oil that would normally pressurize the cylinder 44 of FIG. 1 upon actuation of the cylinder's control valve 46 of FIG. 1 to pivot the bucket 38 of FIG. 1 forward to further excavate the opening 49 of FIG. 1 is now diverted to the oil sump. In other words, when the solenoid valve 62 is actuated, the bucket 38 of FIG. 1 cannot be pivoted forward to further excavate the opening 49 of FIG. 1 regardless of whether an operator actuates the control valve 46 for the cylinder 44 to effectuate such forward movement of the bucket. In this way, the backhoe 10 of FIG. 1 is temporarily disabled from performing any further digging.

The solenoid valve 62 only operates to bypass the hydraulic fluid that would otherwise flow to the cylinder 44 to cause the cylinder to pivot the bucket 38 of FIG. 1 forward to further excavate the opening 49 of FIG. 1. The hydraulic oil that flows to the cylinder 44 of FIG. 1 to cause the cylinder to pivot the bucket 38 backward (clockwise) is not diverted. Thus, even when the solenoid valve 62 is actuated, the bucket 38 of FIG. 1 may still be pivoted backward to permit its withdrawal from the opening 49. Note that once the backhoe 10 is moved sufficiently distant from the buried cable 50 to no longer be a threat thereto, then the solenoid valve 62 will be de-actuated to resume a digging operation.

The controller 53 of the system 51 of the invention can be easily modified, if desired, to add a second solenoid valve (not shown) that would be actuated in unison with the valve 62 to bypass the flow of hydraulic oil that would otherwise flow to the cylinder 36 of FIG. 1 to cause the arm 30 to pivot forward (counterclockwise). Thus, in addition to inhibiting the forward pivotal movement of the bucket 38, the system 51 would also inhibit the forward pivotal movement of the arm 30.

In the preferred embodiment, the system 51 has been depicted as including the combination of the transmitter 56 and the receiver 56 for actuating the solenoid valve 62 when the detector 54 has detected the presence of the buried cable 50. Note that the detector 54 could be coupled (i.e., "hard-wired") directly to the solenoid valve 62 via a metallic wire or optical fiber link (not shown), thus obviating the need for the transmitter 56 and the receiver 60. However, such a metallic cable or optical fiber link would be subjected to repeated flexing as the arm 30 and the boom 18 pivot, possibly causing premature failure, thus making it more desirable to employ an RF link (via the transmitter 56 and receiver 60) for coupling the detector 54 to the valve 62.

It is to be understood that the above-described embodiments are merely illustrative of the principles of the invention. Various modifications and changes may be made thereto by those skilled in the art which will embody the principles of the invention and fall within the spirit and scope thereof.

I claim:

1. A method for controlling a piece of excavation equipment that is excavating near a buried cable and/or pipe, that carries a locating signal independent of the control of the excavation equipment, to prevent the excavation equipment from severing the cable and/or pipe, comprising the steps of:

continuously determining the strength of the locating signal, carried by the cable and/or pipe independent of the control of the excavation equipment, to sense if the buffed cable and/or pipe is sufficiently close to the excavation equipment to be potentially damaged thereby;

alerting the excavation equipment when the buffed cable and/or pipe is sufficiently close to the excavation equipment to be potentially damaged thereby; and temporarily disabling the excavation equipment, upon being alerted if the buried cable and/or pipe is sufficiently close to the excavation equipment to prevent the equipment from further excavating.

2. The method according to claim 1 wherein said detecting step includes the steps of:

transmitting an RF signal from a first part of said excavating equipment when the buried cable and/or pipe is found to be sufficiently close to the excavating equipment; and receiving said RF signal at a second part of said excavating equipment distant from said first part.

3. The method according to claim 1 wherein the step of temporarily disabling the excavation equipment includes the step of diverting hydraulic oil from at least one cylinder of said excavation equipment so that said cylinder cannot be pressurized to facilitate further excavation.

4. Apparatus for temporarily disabling a piece of excavation equipment that is excavating near a buried cable and/or cable that carries a locating signal that is independent of the control of the excavation equipment, comprising:

a detector for detecting if the locating signal that is carried by the buried cable and/or pipe independent of the control of the excavation equipment is above a prescribed threshold, and if, so, then generating an alerting signal of a predetermined magnitude;

means coupled to said detector means and responsive thereto for alerting the excavation equipment of the buried cable and/or pipe; and means coupled to said alerting means for temporarily disabling the excavation equipment upon being alerted of the presence of the buffed cable and/or pipe.

5. The apparatus according to 4 wherein the alerting means comprises:

a transmitter for transmitting an RF signal upon receipt of the alerting signal from said detector; and a receiver responsive to said transmitter for generating a control signal when said RF signal received by said receiver is above a prescribed magnitude.

6. The apparatus according to claim 5 wherein said disabling means comprises at least one valve responsive to said control signal for diverting hydraulic oil from a cylinder of said excavation equipment so that said cylinder cannot facilitate further excavation by said equipment.

* * * * *